US005120164A

United States Patent [19]

Iacocca et al.

[11] Patent Number: 5,120,164

[45] Date of Patent: Jun. 9, 1992

[54] RETAINING WALL AND BLOCK FOR CONSTRUCTING THE SAME

[76] Inventors: Tony Iacocca; Andrew Savoie; Richard Stinchcombe, all of 351 Elizabeth Street, Guelph, Ontario, Canada, N1E 2X9

[21] Appl. No.: 705,489

[22] Filed: May 24, 1991

[51] Int. Cl.[5] ..... E02D 29/02; E02D 17/20; E02B 3/12; E02B 2/12

[52] U.S. Cl. ..... 405/284; 405/286; 52/609

[58] Field of Search ..... 52/608, 609, 610, 579; 405/258, 262, 272, 273, 274, 284, 285, 286; 47/82, 83

[56] References Cited

U.S. PATENT DOCUMENTS

| | | | |
|---|---|---|---|
| 1,023,748 | 4/1912 | McGettigan | 52/609 |
| 1,463,759 | 7/1923 | Carson et al. | 52/609 |
| 1,534,177 | 4/1925 | Guest | 52/609 |
| 1,543,635 | 6/1925 | Wickson | 52/609 X |
| 1,544,478 | 6/1925 | Payne | 52/609 X |
| 3,557,505 | 1/1971 | Kaul | 52/608 X |
| 4,512,685 | 4/1985 | Hegle | 405/284 |
| 4,711,606 | 12/1987 | Leling et al. | 52/608 X |
| 4,909,010 | 3/1990 | Gravier | 52/609 |

FOREIGN PATENT DOCUMENTS

| | | | |
|---|---|---|---|
| 136297 | 1/1934 | Austria | 52/609 |
| 470407 | 1/1952 | Italy | 52/609 |

OTHER PUBLICATIONS

"Paring Stone" Brochure from Betco Block and Products Co., Gainesville, Va.

*Primary Examiner*—Randolph A. Reese
*Assistant Examiner*—John Ricci
*Attorney, Agent, or Firm*—Gowling, Strathy & Henderson

[57] ABSTRACT

A retaining wall and a block for constructing the same. The retaining wall is constructed by superimposing rows of blocks upon each other. The blocks have side, rear, front, top and bottom faces. The side faces are parallel to each other and the rear and front faces are parallel to each other and perpendicular to the side faces. The top and bottom faces are perpendicular to the side, rear and front faces; and both the top and bottom faces are substantially identically Z-shaped. The top and bottom faces are divided into three surfaces, the second surfaces being inclined at an acute angle to the third surfaces. The first surface of the top face is longer than the first surface of the bottom face. Consequently, when the blocks are superimposed upon each other, the front face of each block lies slightly rearwardly with respect to the block immediately below it. This results in the retaining wall being sloped backwardly towards the bank of earth, the angle of the slope corresponding substantially with the angle of inclination of the second surfaces of the top and bottom faces of the blocks.

13 Claims, 5 Drawing Sheets

RETAINING WALL AND BLOCK FOR CONSTRUCTING THE SAME

BACKGROUND OF THE INVENTION

This invention relates generally to a retaining wall and to a block for constructing the same, and more specifically to a retaining wall constructed from a plurality of precast blocks superimposed in rows and to said precast blocks.

SUMMARY OF THE INVENTION

The block of the present invention comprises two parallel side faces, rear and front faces being perpendicular thereto, and top and bottom faces being perpendicular to both the side, rear and front faces. The top and bottom faces are substantially identically Z-shaped when viewed from the side. The top and bottom faces of the precast blocks are both divided into first, second and third surfaces. The first and third surfaces of the top and bottom faces are substantially parallel to each other, while the two second surfaces are substantially parallel to each other The second surfaces are inclined at an acute angle relative to the third surfaces, this acute angle being in the order of 82° to 87°, and preferably 85°.

The first surface of the top face of the blocks is longer than the first surface of the bottom face. This is by virtue of the inclination of the second surface.

The retaining wall of the present invention is constructed by superimposing rows of separate blocks, as above described, upon each other. The base of the bank of earth is excavated and a footing is disposed therein. A row of footing units is laid upon the footing. The footing units are similar to the blocks except that the lower face of each footing unit is substantially flat. A first row of blocks is laid upon the footing units and subsequent rows of blocks are laid thereupon. The uppermost row of blocks has a row of coping units laid thereupon. The coping units are similar to the blocks except that the upper face of each coping unit is substantially flat.

The retaining wall may also include corners constructed by alternating first and second corner units in consecutive rows of blocks.

When the blocks are superimposed upon each other, the front face of each block is disposed slightly rearwardly of the block immediately below it. The retaining wall consequently slopes backwardly towards the bank of earth at an angle corresponding to the angle of inclination of the second surfaces relative to the third surfaces of the blocks.

BRIEF DESCRIPTION OF THE DRAWINGS

The preferred embodiments of the invention will now be described in greater detail with the aid of the following drawings in which.

DETAILED DESCRIPTION OF THE PREFERRED EMBODIMENT OF THE INVENTION

Figure 1:
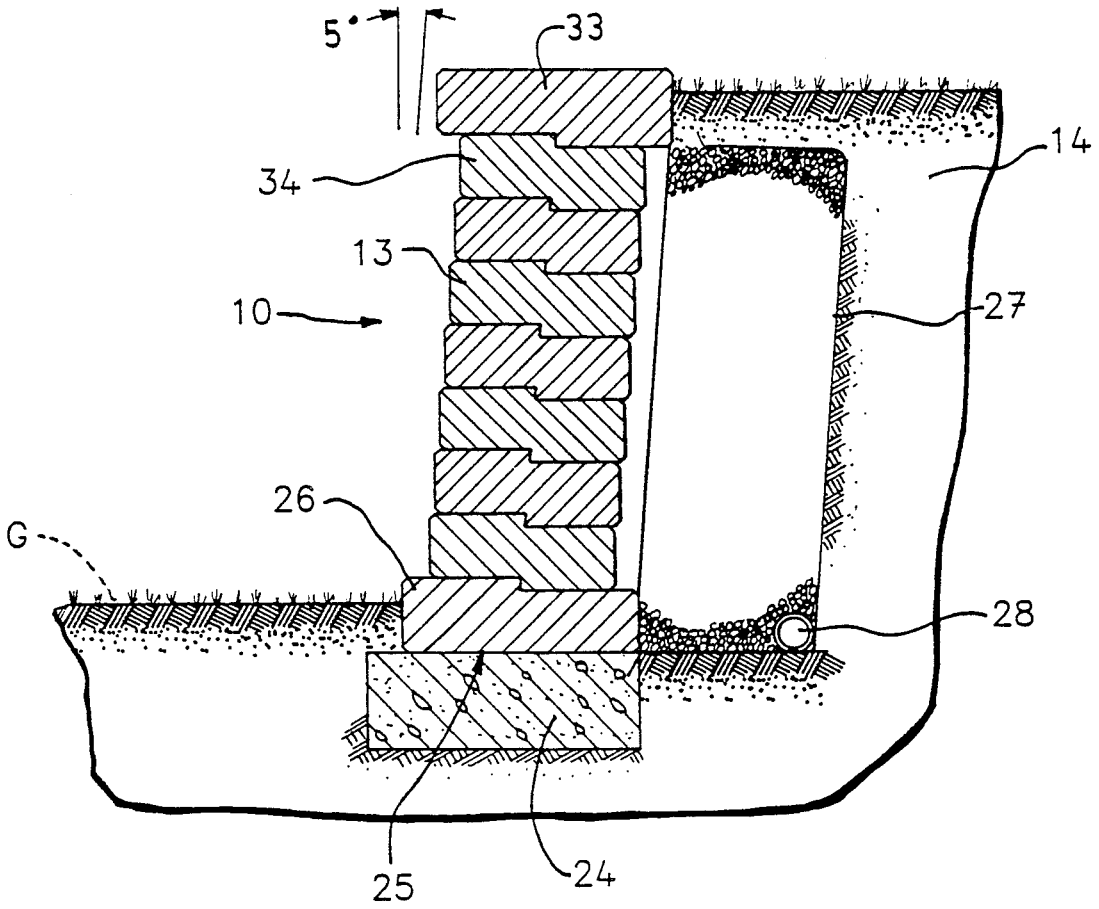
FIG. 1 is a side view of a retaining wall system using the present invention.
Figure 2:
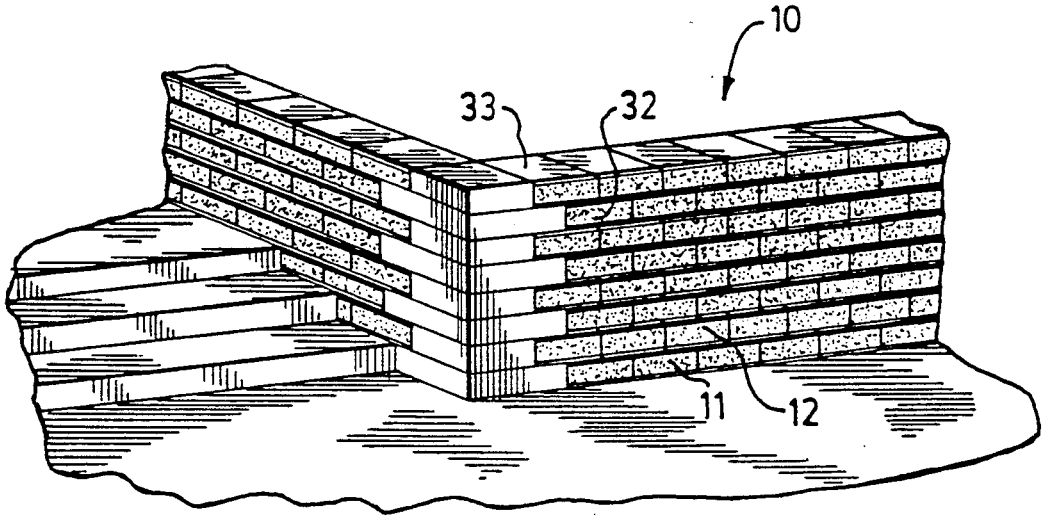
FIG. 2 is a front view of the retaining wall shown in FIG. 1.
Figure 3:
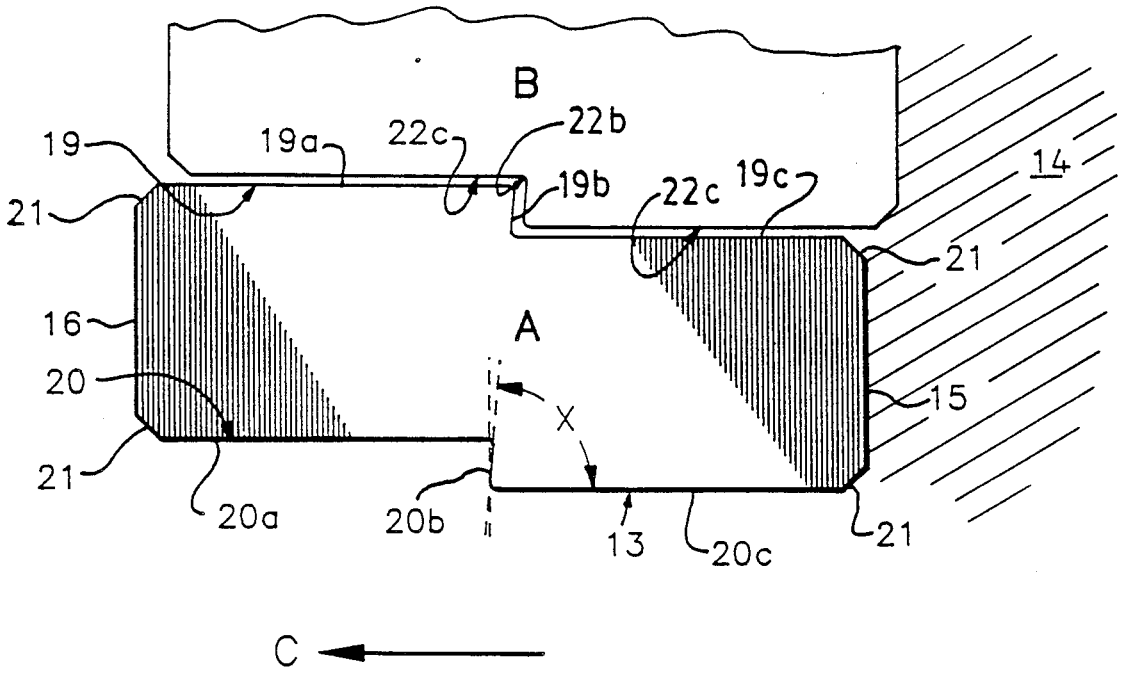
FIG. 3 is a partially exploded side view of a section of the retaining wall shown in FIG. 1, showing the relationship between the blocks which are superimposed upon each other.

Referring to FIGS. 1–3 there is shown a retaining wall 10 comprising a plurality of superimposed rows 11,12 of blocks 13, each row comprising a plurality of blocks 13 butted together end to end. The blocks 13 are shaped in such a manner that when superimposed upon each other they substantially resist the forward movement or collapse of the bank of earth 14 and require essentially no mortar to remain in position. The retaining wall 10 is constructed so as to have a built-in slope, in the direction of the bank of earth, of between 3° and 8° from the vertical, and preferably of 5° from the vertical. This built in slope assists in channelling run-off from the bank of earth and thereby prolongs the life of the retaining wall 10.

Figure 7:
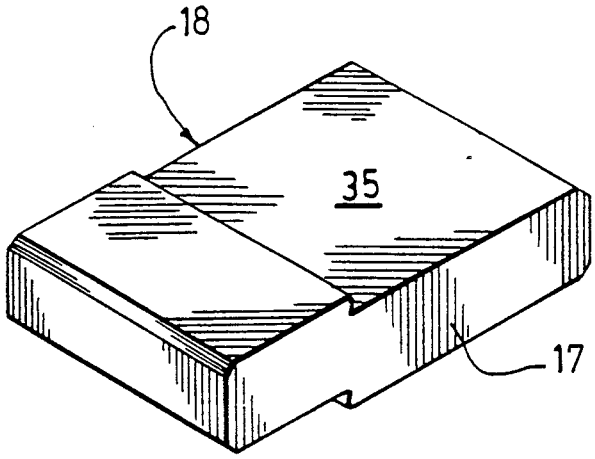
FIG. 7 is a perspective view of an extended block as shown in FIG. 5.

Referring to FIG. 3, each block 13 has a rear face 15 which is adapted to be disposed proximate the bank of earth 14; a front face 16 adapted to be disposed remote from the bank of earth; two side faces 17,18 (FIG. 7); a top face 19 and a bottom face 20. (The terms front, rear, top and bottom are used for convenience as illustrated herein, and use of these terms does not preclude other orientations of the block.) The side faces 17,18 are substantially parallel to each other and the front and rear faces 16,15 are substantially parallel to each other and substantially perpendicular to the side faces 17,18. The top face 19 and the bottom face 20 are substantially perpendicular to the side faces 17,18 and to the front and rear faces 16,15.

The top face 19 and bottom faces 20 are divided into three surfaces **19*a*,19*b*,19*c* and 20*a*,20*b*,20*c* respectively. When viewed from the side, both the top face 19 and bottom face 20 are a substantially identical shallow Z-shape. The surfaces 19*a*,19*c*, 20*a*,20*c* are substantially flat and parallel to each other, but the surfaces 19*c*,20*c*, disposed proximate the bank of earth 14, are disposed a spaced distance downwardly from the surfaces 19*a*,20*a*. The second top face surface 19*b* is disposed between the surfaces 19*a* and 19*c*; and similarly the second bottom face surface 20*b* is disposed between the surfaces 20*a* and 20*c*. The second surfaces 19*b*,20*b* are inclined at an acute angle relative to the third surfaces 19*c*,20*c*. This angle is anywhere between 82° and 87° relative to the third surfaces 19*c*,20*c*, and preferably at an angle of 85° relative to the third surfaces. The second surfaces 19*b*,20*b* are substantially parallel to each other. The first and third surfaces 19*a*,20*a* and 19*c*,20*c* are longer than the second surfaces 19b,20b. A bevel 21** is provided along the edges of the block.

Referring to FIG. 3, when two blocks 13 are laid one on top of the other, the top face 19 of the lowermost block A interlocks with the bottom face 22 of the uppermost block B; surfaces 19a & 22a; 19b & 22b; and 19c and 22c lying against each other. The lap-type joint so formed between the blocks A and B substantially prevents movement of the block B away from the bank of earth 14 in the direction of arrow C. The retaining wall consequently prevents the movement of the bank of earth 14 in the direction of arrow C.

When viewed from the side, the first surface 19a of the top face is longer than the first surface 20a of the bottom face, and correspondingly, the third surface 19c of the top face is shorter than the third surface 20c of the bottom face. Consequently, when the blocks are superimposed upon each other the front face of a block B (FIG. 3) is disposed slightly rearwardly of the front face of the block A immediately below it. This arrangement results in the retaining wall sloping backwardly towards the bank of earth 14. The angle of the slope of the retaining wall corresponds to the angle of inclination of the second surfaces 19b,20b of the blocks.

Figure 4:
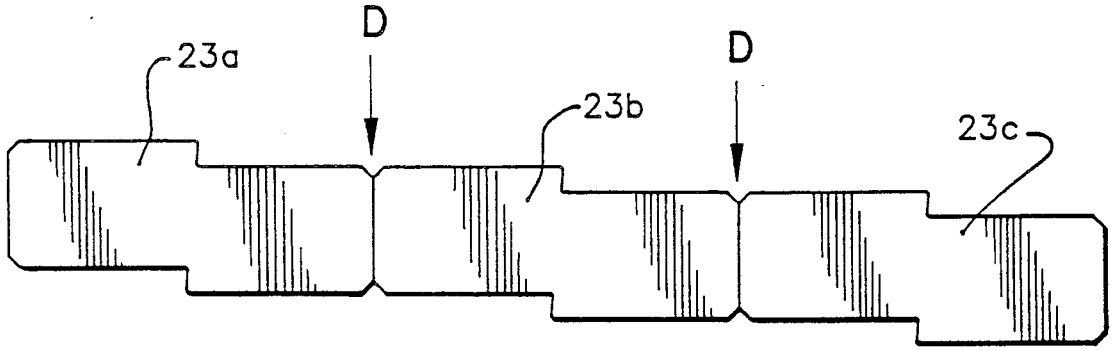
FIG. 4 is a side view of a plurality of blocks after being removed from the mould and before separation at the jobsite.

The blocks 13 are precast concrete, or any other suitable material, and are cast in moulds to form a number of blocks attached to each other. Groups of blocks (such as that shown in FIG. 4) maybe transported as units to the wall construction site and separated prior to installation in the wall. The blocks 23a,23b,23c may be separated by striking the boundary D with a chisel or the like.

Figure 5:
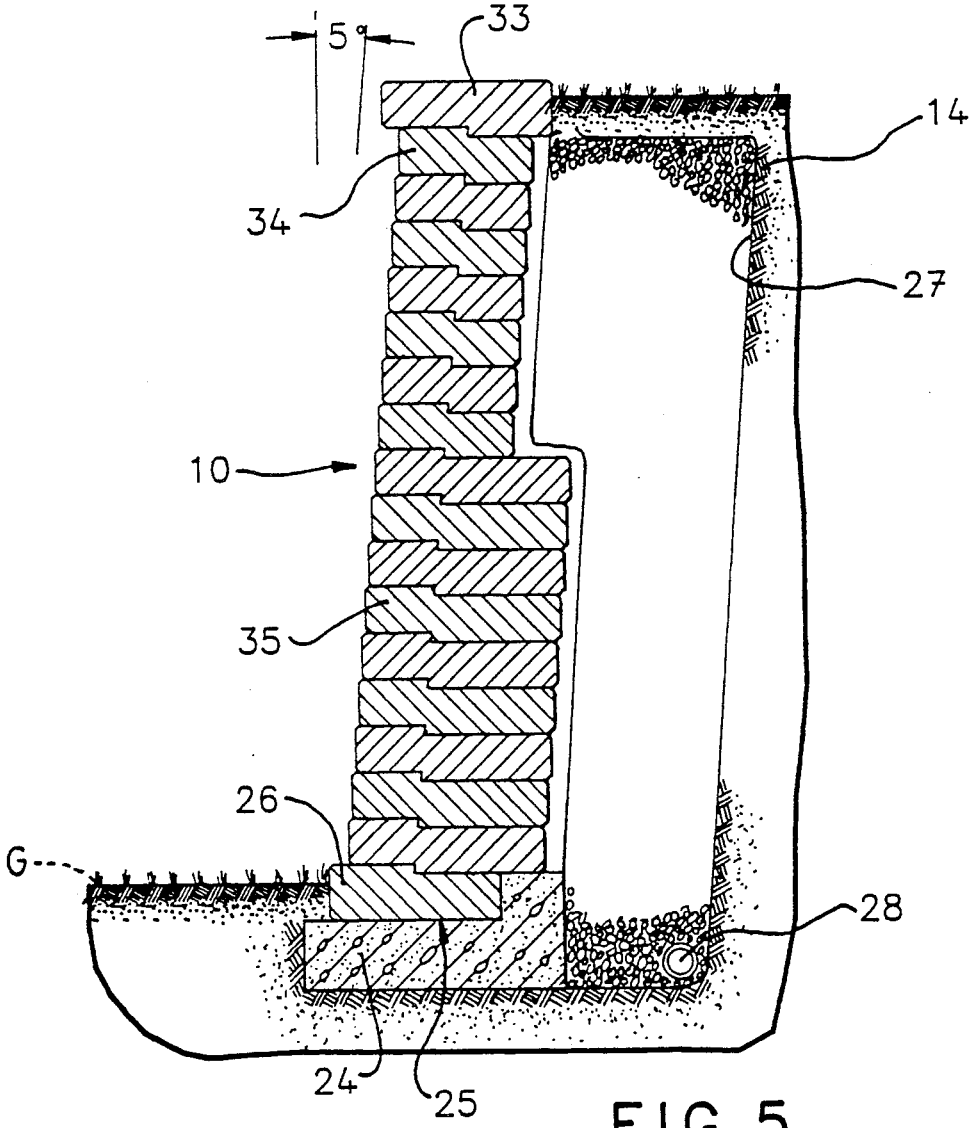
FIG. 5 is a side view of a retaining wall of greater height than that shown in FIG. 1 showing the use of extended blocks.

In building a retaining wall incorporating the previously described blocks, the area at the base of the bank of earth, and, where necessary, the bank of earth itself, must be properly prepared. Referring to FIGS. 1 or 5, a trench (not shown) is dug along the base of the bank of earth 14 and a footing 24 of concrete or compacted crushed stone is placed in the trench. The upper surface 25 of the footing 24 is levelled to provide a substantially horizontal surface for the placement of a row of footing units 26. Where necessary, an area of the bank of earth is also excavated for placement of a filter cloth 27, drainage pipes 28 and the like to take care of such problems as water build up behind the retaining wall 10. A row of footing units 26 is laid in end to end abutment upon the footing 24. Each footing unit 26 (FIG. 5) has a bottom face 29 which is substantially flat and a top face 30 which is divided into three surfaces 30a,30b,30c in the same manner as the top faces of the blocks 13. As with the blocks 13, the second surface 30b is inclined at an acute angle of between 82° and 87° relative to the third surface 30c, and preferably at an angle of 85° relative to the third surface 30c. The second surface 30b is inclined towards the rear face 31 of the footing unit 26. The footing units 26 may be positioned so that the front face 32 is either at least partially visible above ground level G (FIG. 5), or entirely buried below ground level G (FIG. 1).

A first row 11 of blocks 13 is laid on top of the row of footing units 26 (FIG. 2). The blocks 13 in the first row 11 are laid in end to end abutment with each other. The bottom face 20 of the blocks 13 interlocks with the top face 30 of the footing units 26. A second row 12 of blocks 13 is laid upon the first row 11 of blocks. The blocks in the rows are laid in a staggered fashion, so that the ends of the blocks in adjacent rows are not aligned with each other, but are rather aligned with the ends of the blocks in alternate rows. This is illustrated in FIG. 2. The staggered alignment of the ends of the blocks increases the stability and the life of the retaining wall.

A row of coping units 33 is superimposed upon the uppermost row 34 of blocks 13. The coping units 33 are similar in shape to the footing units 26 (FIG. 6), but are laid in an inverted manner so that the top face 30 of the footing unit 26 forms the bottom face of the coping unit 33; and the bottom face 29 of the footing unit 26 forms the top face of the coping unit 33. A butyl tape is generally used to join the coping units 33 to the uppermost row 34 of blocks to prevent possible dislodgement of the coping units 33.

Figure 6:
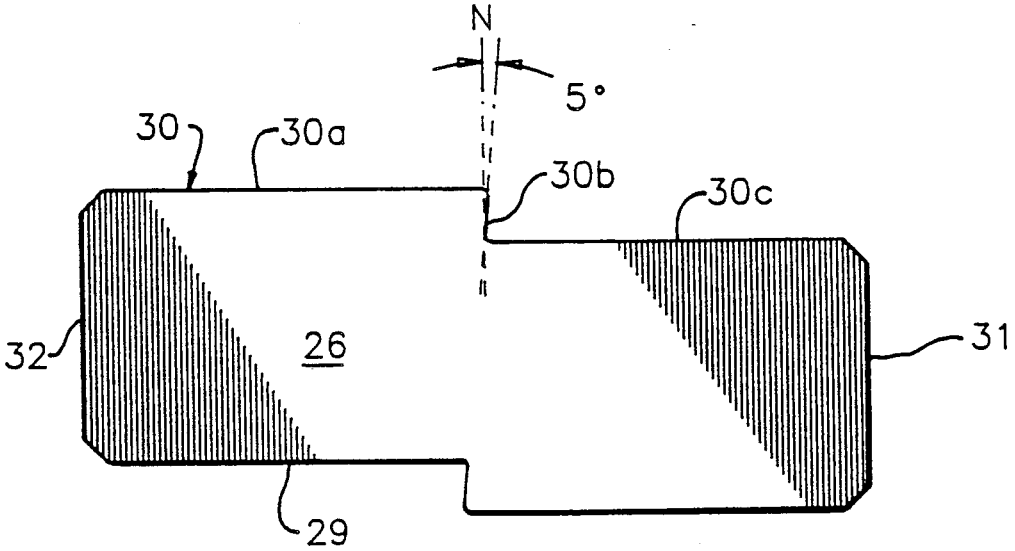
FIG. 6 is a perspective view of the coping unit and/or the footing unit used in the retaining wall shown in FIG. 1.
Figure 8:
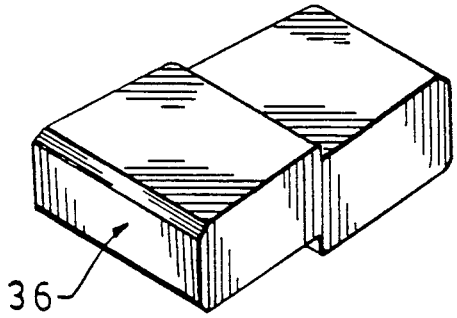
FIG. 8 is a perspective view of a tapered block for use in the retaining walls shown in FIG. 1 and 5.

The dimensions of a block 13 in the preferred embodiment of this invention are 300 mm×300 mm×100 mm. Using blocks 13 of this size, retaining walls in the order of 1.2 m (4'0") can easily be constructed. The dimensions of the footing units 26 (and coping units 33) used in such walls are in the order of 600 mm×325 mm×75 mm. If walls of greater height are required, extended blocks such as the blocks 35 shown in FIGS. 5 and 6 are used in the bottom rows of the wall and blocks 13 are used in the upper rows of the wall. The extended blocks 35 have dimensions in the order of 300 mm×450 mm×100 mm. Sections of retaining wall may also require that tapered blocks such as that shown in FIG. 8 are necessary. The length of the front face 36 of the tapered block is around 200 mm, while the length of the rear face is around 165 mm. The width of the block is 300 mm and the height 100 mm.

Figure 9:
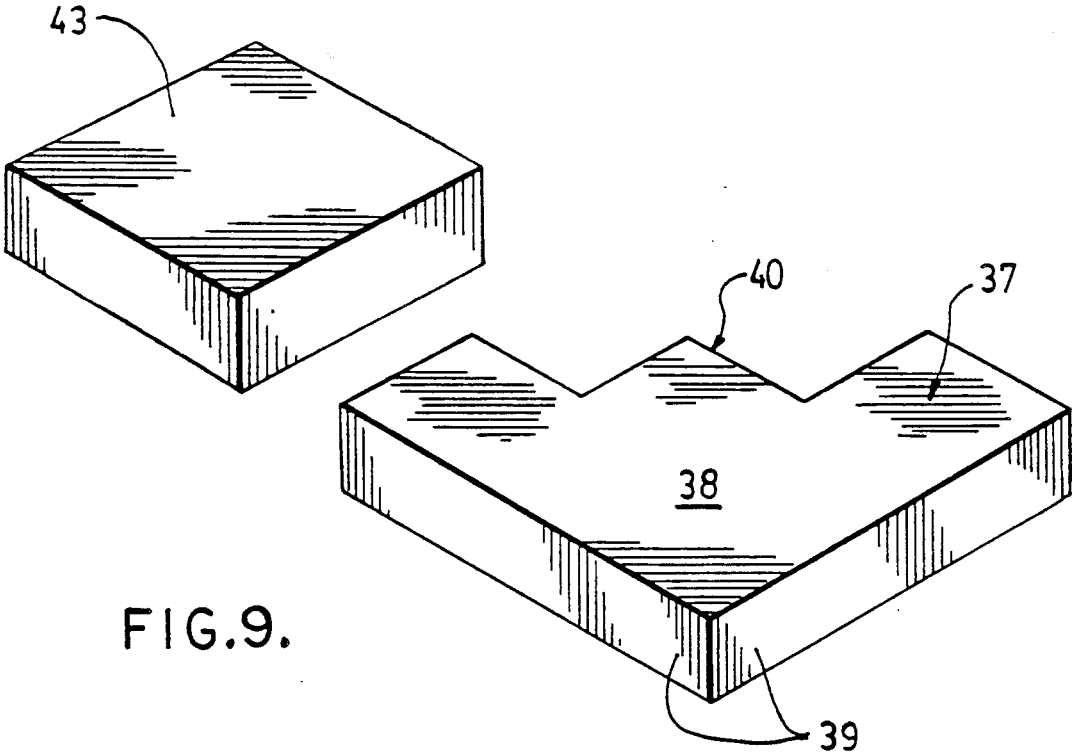
FIG. 9 is a perspective view of the two types of corner units used in the retaining walls shown in FIG. 1 and 5.
Figure 10:
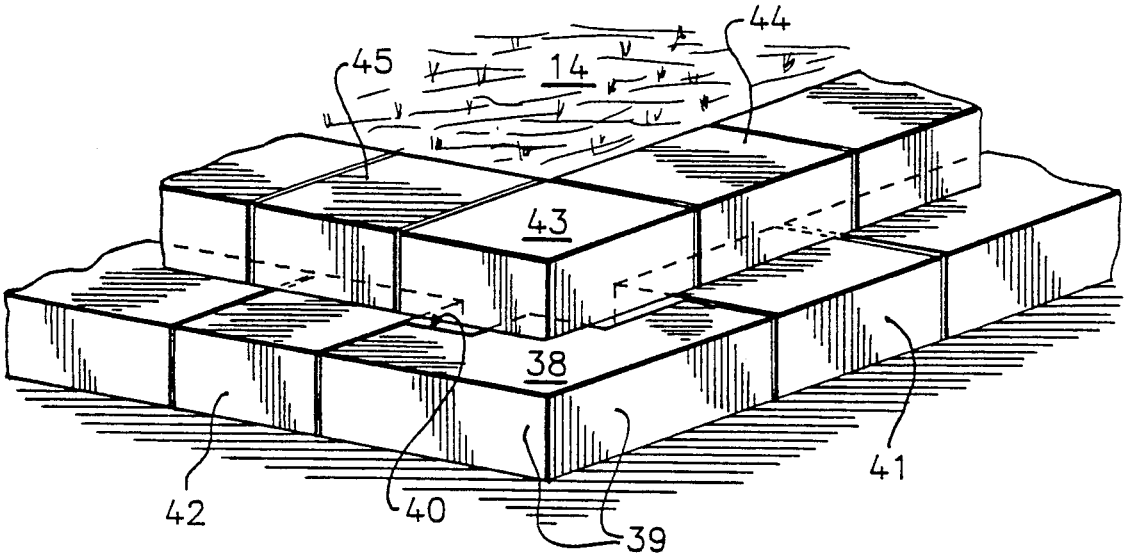
FIG. 10 is an exploded perspective view showing the vertical arrangement of two rows of blocks forming a corner in the retaining wall.

Retaining walls having corners may also be constructed. In this instance corner units may be used. The corners are constructed by laying alternating first and second corner units in consecutive rows of blocks. As shown in FIGS. 9 and 10, the first corner units 37 have a lower surface (not shown), and an upper surface 38 substantially parallel to the lower surface. A substantially V-shaped outer surface 39, (when viewed from above) is adapted to be disposed remote from the bank of earth 14. The outer surface 39 is substantially perpendicular to the upper and lower surfaces of the corner unit 37. A substantially "stepped" shaped inner surface 40, (when viewed from above) lies substantially perpendicular to the upper and lower surfaces of the corner unit 37 and is adapted to be disposed proximate the bank of earth 14. The inner surface 40 connects to the outer surface 39 at substantially right angles. Blocks 41 and 42 butt against the first corner unit 37. The dimensions of the first corner units 37 are 450 mm×450 mm×100 mm. Each "step" in the corner unit 37 is 150 mm by 150 mm×100.

Figure 11:
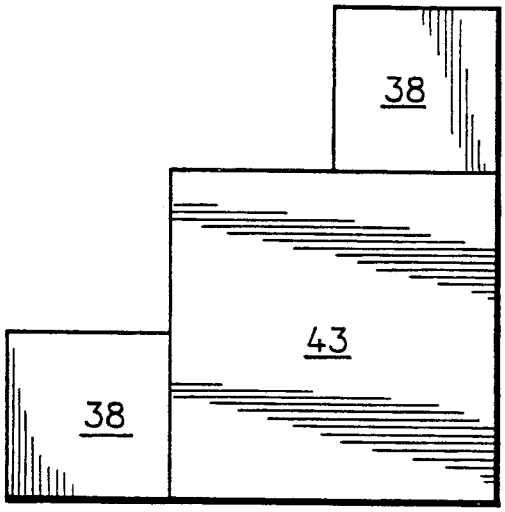
FIG. 11 is a plan view of a second corner unit superimposed upon a first corner unit.

A substantially square-shaped second corner unit 43 is laid upon the first corner unit 37 as shown in FIG. 10. When viewed from above a portion of the first corner unit 37 protrudes from either side of the second corner unit 43 (FIG. 11). Blocks 44 and 45 butt against the second corner unit 43 and interlock with blocks 41 and 42. Another first corner unit (not shown) is laid upon the second corner unit 43 and so on. The dimensions of the second corner units 43 are 300 mm×300 mm×100 mm. The first and second corner units 37,38 must be alternated in order to maintain the staggered alignment of the blocks in adjacent rows.

The resultant wall retains the bank of earth 14 and is has a built in slope in the order of between 3° and 8° from the vertical and preferably of 5° from the vertical. The interlocking action between the blocks resulting from the angled second surfaces contacting each other, tends to assist in preventing the blocks in the upper rows of the wall from sliding relative to the blocks beneath them.

Variations in the above invention will be obvious to those skilled in the art, and such obvious variations are contemplated to fall within the scope of the invention.

The embodiments of the invention in which exclusive property or privilege is claimed are defined as follows:

1. A precast block for building retaining walls, said block comprising:

two parallel side faces;

a rear face adapted to be disposed proximate a bank of earth; said rear face being perpendicular to said side faces;

a front face adapted to be disposed remote from the bank of earth; said front face being perpendicular to said side faces;

substantially identically Z-shaped top and bottom faces, said top and bottom faces being substantially parallel to each other and perpendicular to said side, front and rear faces, the top and bottom faces being divided into first, second and third surfaces; the first surface being disposed proximate the front face of the block and the third surface being disposed proximate the rear face of the block; and the first surface of the bottom face being shorter than the first surface of the top face of the block.

2. A precast block as defined in claim 1, wherein the second surfaces are inclined at an angle to the first and third surfaces, and the second surfaces are inclined at an angle of between 82° and 87° relative to the third surfaces.

3. A precast block as defined in claim 2, wherein the second surfaces are inclined at an angle of 85° relative to the third surfaces.

4. A precast block as defined in claim 1, wherein the first and third surfaces of the top and bottom faces are substantially flat.

5. A precast block as defined in claim 1, wherein the first and third surfaces are longer than the second surfaces when viewed from the side.

6. A wall for retaining a bank of earth or the like comprising a plurality of separate blocks superimposed in rows, said blocks comprising:

two parallel side faces;

a rear face adapted to be disposed proximate a bank of earth; said rear face being perpendicular to said side faces;

a front face adapted to be disposed remote from the bank of earth; said front face being perpendicular to said side faces;

substantially identically Z-shaped top and bottom faces, said top and bottom faces being substantially parallel to each other and perpendicular to said side, front and rear faces, the top and bottom faces being divided into first, second and third surfaces; the first surface being disposed proximate the front face of the block and the third surface being disposed proximate the rear face of the block; and the first surface of the bottom face being shorter than the first surface of the top face of the block;

so that when the blocks are superimposed upon each other to form a retaining wall, the difference in length between the first surfaces of the top and bottom faces causes the front face of a first block in the wall to be disposed slightly rearwardly of the front face of a second block disposed immediately below the first block, and the resulting retaining wall is inclined slightly backwardly towards the bank of earth.

7. A wall for retaining a bank of earth as defined in claim 6, wherein the second surfaces of the blocks are inclined at an angle to the first and third surfaces, and the second surfaces are inclined at an angle of between 82° and 87° relative to the third surfaces.

8. A wall for retaining a bank of earth as defined in claim 7, wherein the second surfaces of the blocks are inclined at an angle of 85° relative to the third surfaces.

9. A wall for retaining a bank of earth as defined in claim 6, wherein the wall slopes backwardly towards the bank of earth at an angle of between 3° and 8° relative to the vertical.

10. A wall for retaining a bank of earth as defined in claim 9, wherein the wall slopes backwardly towards the bank of earth at an angle of 5° relative to the vertical.

11. A wall for retaining a bank of earth as defined in claim 6, wherein the first and third surfaces of the top and bottom faces of the blocks are substantially flat.

12. A wall for retaining a bank of earth as defined in claim 6, wherein the first and third surfaces of the blocks are larger than the second surfaces when viewed from the side.

13. A wall for retaining a bank of earth as defined in claim 6, wherein the blocks of the superimposed rows are connected together by mortarless lap joints.

* * * * *